US009530356B2

(12) United States Patent
Min et al.

(10) Patent No.: US 9,530,356 B2
(45) Date of Patent: Dec. 27, 2016

(54) SOURCE DRIVER OF DISPLAY DEVICE

(71) Applicant: SILICON WORKS CO., LTD., Daejeon-si (KR)

(72) Inventors: Kyung Jik Min, Seoul (KR); Hyun Kyu Jeon, Daejeon-si (KR); Yong Ik Jung, Incheon (KR); Hyun Ho Cho, Incheon-si (KR); Young Bok Kim, Daejeon-si (KR)

(73) Assignee: SILICON WORKS CO., LTD., Daejeon-Si (KR)

( * ) Notice: Subject to any disclaimer, the term of this patent is extended or adjusted under 35 U.S.C. 154(b) by 172 days.

(21) Appl. No.: 14/499,363

(22) Filed: Sep. 29, 2014

(65) Prior Publication Data

US 2015/0091888 A1 Apr. 2, 2015

(30) Foreign Application Priority Data

Sep. 30, 2013 (KR) ..... 10-2013-0116392

(51) Int. Cl.
*G09G 3/3208* (2016.01)
*G09G 3/32* (2016.01)

(52) U.S. Cl.
CPC ..... *G09G 3/3291* (2013.01); *G09G 2300/043* (2013.01); *G09G 2300/0819* (2013.01); *G09G 2310/027* (2013.01); *G09G 2310/0291* (2013.01); *G09G 2310/0294* (2013.01); *G09G 2320/0233* (2013.01); *G09G 2320/045* (2013.01)

(58) Field of Classification Search
CPC ..... G09G 3/3291; G09G 2300/043; G09G 2300/0819; G09G 2310/027; G09G 2310/0294;G09G 2320/0233; G09G 2320/045; G09G 2310/0291
See application file for complete search history.

(56) References Cited

U.S. PATENT DOCUMENTS 4,365,204 A * 12/1982 Haque ..... H03F 3/005 327/337
4,439,693 A * 3/1984 Lucas ..... G11C 27/026 327/100

(Continued)

FOREIGN PATENT DOCUMENTS

JP 2513051 4/1996
JP 9-81078 3/1997

(Continued)

*Primary Examiner* — Julie Anne Watko
(74) *Attorney, Agent, or Firm* — Kile Park Reed & Houtteman PLLC

(57) ABSTRACT

A source driver may include: a transmission line configured to transmit an output signal of a sample and hold circuit which stores pixel information of an organic light emitting diode (OLED) cell; an amplifier is formed a first offset voltage at an input terminal by a parasitic capacitor of the transmission line; and an offset voltage storage unit configured to store the first offset voltage outputted from the amplifier as a second offset voltage while the transmission of the output signal of the sample and hold circuit through the transmission line is turned off, and offset the first offset voltage by providing the second offset voltage to the input terminal of the amplifier when the output signal of the sample and hold circuit is transmitted through the transmission line.

9 Claims, 8 Drawing Sheets

(56) References Cited

U.S. PATENT DOCUMENTS

| | | | | |
|---|---|---|---|---|
| 6,169,440 | B1 * | 1/2001 | Liu | G06G 7/1865 327/336 |
| 6,795,117 | B2 * | 9/2004 | Tay | H04N 1/32358 348/241 |
| 8,258,818 | B2 * | 9/2012 | Debnath | G11C 27/024 327/337 |
| 2004/0263440 | A1 * | 12/2004 | Kimura | G09G 3/2011 345/76 |
| 2009/0033371 | A1 * | 2/2009 | Braswell | G11C 27/026 327/65 |
| 2012/0249237 | A1 * | 10/2012 | Garrity | H03F 3/005 330/127 |
| 2013/0050116 | A1 * | 2/2013 | Shin | G06F 3/044 345/173 |

FOREIGN PATENT DOCUMENTS

| | | |
|---|---|---|
| JP | 9-259597 | 10/1997 |
| KR | 10-2005-0059683 | 6/2005 |
| KR | 10-2013-0000696 | 1/2013 |

* cited by examiner

SOURCE DRIVER OF DISPLAY DEVICE

BACKGROUND OF THE INVENTION

Field of the Invention

The present invention relates to a display device, and more particularly, to a source driver for driving a display panel.

Description of the Related Art

With the development of information technology (IT), the use of display devices have rapidly increased. A display device includes a display panel for displaying an image and a plurality of drivers for driving the display panel. A part of the drivers may include gate drivers to drive scan lines formed in the display panel, and the other part of the drivers may include source drivers to drive data lines formed in the display panel.

In the case of a display panel using an organic light emitting diode (OLED), the source driver includes a plurality of sample and hold (S/H) circuits configured to detect changes in pixel information of a plurality of pixels formed in the display panel.

The sample and hold circuit is provided at each output channel of the source driver so as to detect pixel information. Thus, the source driver includes a plurality of sample and hold circuits corresponding to the number of output channels. A signal outputted from a sample and hold circuit may be converted into a digital signal by an analog-to-digital converter, and then provided to a timing controller.

Furthermore, for a high-speed operation of the analog-to-digital converter, the signal of the sample and hold circuit needs to be amplified and provided. For this operation, an amplification unit is configured to amplify the signal of the sample and hold circuit and provide the amplified signal to the analog-to-digital converter. An offset voltage may be formed at an input terminal of the amplification unit. When the number of sample and hold circuits is increased, a parasitic capacitor may be formed in a transmission line of the amplification unit which receives the output signal of the sample and hold circuit, and parasitic capacitance caused by the parasitic capacitor may be increased.

The increase of the parasitic capacitance may increase the offset voltage generated at the input terminal of the amplification unit. As a result, a difference in offset voltage between the source drivers may occur to thereby reduce the yield of the source drivers.

SUMMARY OF THE INVENTION

Accordingly, the present invention has been made in an effort to solve the problems occurring in the related art, and an object of the present invention is to provide a source driver capable of controlling an offset voltage of an input terminal of an amplification unit which amplifies an output signal of a sample and hold circuit.

Another object of the present invention is to provide a source driver which controls amplification of an offset voltage by a parasitic capacitor formed at an input terminal of an amplification unit coupled to a sample and hold circuit, thereby preventing a difference in offset voltage between source drivers and increasing a yield.

In order to achieve the above object, according to one aspect of the present invention, a source driver may include: a transmission line configured to transmit an output signal of a sample and hold circuit which stores pixel information of an organic light emitting diode (OLED) cell; an amplifier is formed a first offset voltage at an input terminal by a parasitic capacitor of the transmission line; and an offset voltage storage unit configured to store the first offset voltage outputted from the amplifier as a second offset voltage while the transmission of the output signal of the sample and hold circuit through the transmission line is turned off, and offset the first offset voltage by providing the second offset voltage to the input terminal of the amplifier when the output signal of the sample and hold circuit is transmitted through the transmission line.

According to another aspect of the present invention, a source driver may include: a sample and hold circuit configured to perform a sampling mode for storing pixel information inputted from an OLED cell of a display panel and an amplification mode for outputting the stored pixel information; an amplifier is formed a first offset at an input terminal, and configured to output a second offset voltage corresponding to the first offset voltage in response to the sampling mode and amplify an output signal of the sample and hold circuit, applied to the input terminal through a transmission line, in response to the amplification mode; an offset voltage storage unit configured to store the second offset voltage in response to the sampling mode, and provide the second offset voltage to the input terminal of the amplifier in response to the amplification mode; and a feedback capacitor configured to store a voltage for amplification in response to the sampling mode, and provide a feedback path for the amplifier in response to the amplification mode.

According to another aspect of the present invention, a source driver may include: a first sample and hold circuit configured to store pixel information inputted from an OLED cell of a display panel in response to a sampling mode, and output the stored pixel information in response to an amplification mode; a second sample and hold circuit configured to store a reference voltage in response to the sampling mode and output the stored reference voltage in response to the amplification mode; and an amplification unit configured to store first and second offset voltages of positive and negative input terminals as third and fourth offset voltages in response to the sampling mode, offset the first and second offset voltages by the third and fourth offset voltages in response to the amplification mode, and differentially amplify output signals of the first and second sample and hold circuits, provided through a transmission line.

According to another aspect of the present invention, a source driver may include: a sample and hold circuit configured to perform a sampling mode for storing an input signal and an amplification mode for outputting the input signal; an amplifier configured to output a first offset voltage in response to the sampling mode, and amplify and output an output signal of the sample and hold circuit in response to the amplification mode; and an offset voltage storage unit configured to store the first offset voltage of the amplifier as a second offset voltage having the opposite polarity, in response to the sampling mode, and offset the first offset voltage by providing the second offset voltage to an input terminal of the amplifier in response to the amplification mode.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Figure 1:
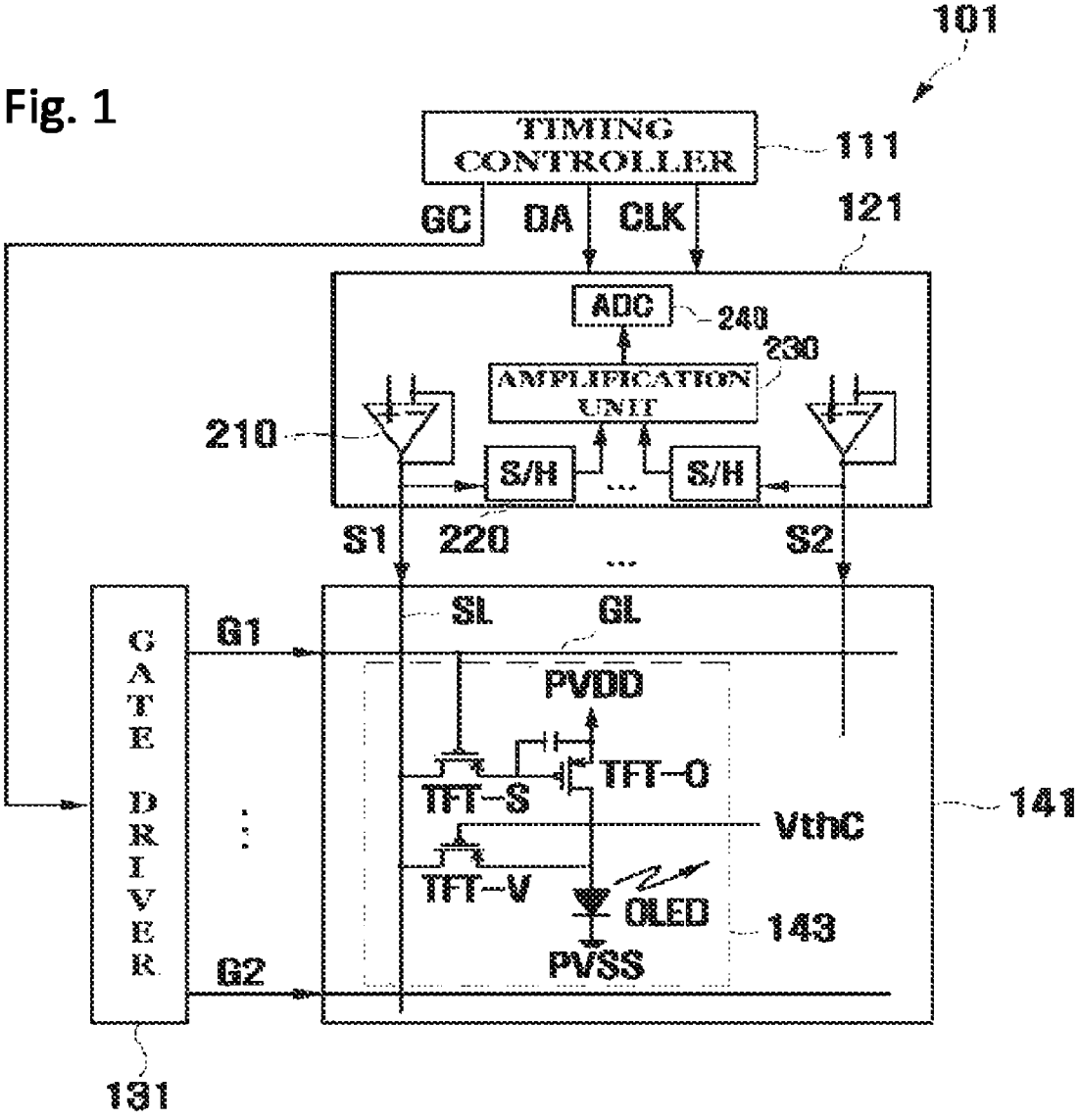
FIG. 1 is a block diagram illustrating an embodiment of a display device in accordance with the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is a block diagram of a display device 101 to which an embodiment of the present invention is applied. Referring to FIG. 1, the display device 101 may include a timing controller 111, a source driver 121, a gate driver 131, and a display panel 141.

The timing controller 111 may transmit image data DA and a clock signal CLK to the source driver 121, and transmit a gate control signal GC to the gate driver 131.

The source driver 121 may receive the clock signal CLK and the image data DA from the timing controller 111, process the image data DA in synchronization with the clock signal CLK, and output source driving signals S1 and S2 to the display panel 141 so as to drive data lines SL formed in the display panel 141. FIG. 1 illustrates one source driver 121, but the display device 101 may include a plurality of source drivers 121 in consideration of the size and resolution of the display panel 141.

The source driver 121 may include output buffers 210, sample and hold circuits 220, an amplification unit 230, and an analog-to-digital converter 240. The output buffers 210 may output the source driving signals S1 and S2, respectively. The sample and hold circuits 220 may detect pixel information transmitted from the display panel 141. The amplification unit 230 may amplify output signals of the sample and hold circuits 220. The analog-to-digital converter 240 may convert the output signals of the amplification unit 230 into digital signals. Although not illustrated, the source driver 121 may further include a shift register (not illustrated), a latch (not illustrated), and a digital-to-analog converter (not illustrated), in order to process the image data DA in synchronization with the clock signal CLK. Signals processed through the digital-to-analog converter may be outputted as the source driving signals S1 and S2 through the output buffers 210, respectively.

The output signals of the analog-to-digital converter 240 may be provided to the timing controller 111, and the timing controller 111 may perform a control operation reflecting the pixel information by referring to the output signals of the analog-to-digital converter 240.

The amplification unit 230 may amplify the output signals of the sample and hold circuits 220, in order to guarantee the high-speed operation of the analog-to-digital converter 240.

The sample and hold circuit 220 may recognize pixel information of an OLED cell 143, transmitted through a data line SL of the display panel 141. The pixel information may include a turn-on voltage of an OLED, a threshold voltage Vth of a thin film transistor (TFT), a current characteristic of the TFT, and a mobility characteristic of the TFT. Among the characteristics, the current characteristic of the TFT may be sensed through a voltage.

The gate driver 131 may receive a gate control signal GC outputted from the timing controller 111, generate gate driving signals G1 and G2 using the gate control signal GC, and output the gate driving signals G1 and G2 to drive the scan lines GL formed in the display panel 141. FIG. 1 illustrates one gate driver 131, but the display device may include a plurality of gate drivers 131 in consideration of the size and resolution of the display panel 141.

The display panel 141 may receive the source driving signals S1 and S2 and the gate driving signals G1 and G2 from the source driver 121 and the gate driver 131, respectively, and display an image. In the present embodiment, the display panel 141 may include pixels implemented by using organic light emitting diode (OLED) cells 143. The OLED cell 143 may receive a source driving signal of a data line SL and a gate driving signal of a scan line GL, and display an image in response to the operation of an OLED.

The operation of the OLED cell 143 may be described in detail as follows. According to the gate driving signal G1 supplied to the scan line GL, a switching thin film transistor TSF-S of the data line SL may be turned on. Then, the source driving signal S1 supplied through the data line SL may be supplied to the gate of a driving thin film transistor TFT-O through the switching thin film transistor TFT-S. The driving thin film transistor TFT-O may be turned on by the source driving signal S1 transmitted through the switching thin film transistor TFT-S, and apply voltages PVDD and PVSS to the organic light emitting diode OLED. As a driving current is supplied at brightness corresponding to the source driving signal S1, the organic light emitting diode OLED may emit light.

Since the organic light emitting diode OLED gradually deteriorates with time, the threshold voltage Vth thereof may be changed. Then, due to the change of the threshold voltage Vth, the brightness of the organic light emitting diode OLED may gradually decrease in response to the same driving current. The change in threshold voltage Vth of the organic light emitting diode OLED may be detected through a threshold-voltage-detection thin film transistor TFT-V. At this time, a threshold-voltage-detection control signal VthC for detecting the change in threshold voltage Vth of the organic light emitting diode OLED may be provided to the threshold-voltage-detection thin film transistor TFT-V in a standby state or before an image is displayed. The above-described change of the threshold voltage Vth may correspond to an example of pixel information. The pixel information such as the threshold voltage Vth of the organic light emitting diode OLED may be provided to the sample and hold circuit 220 through the turned-on threshold-voltage-detection thin film transistor TFT-V and the data line SL.

Figure 2:
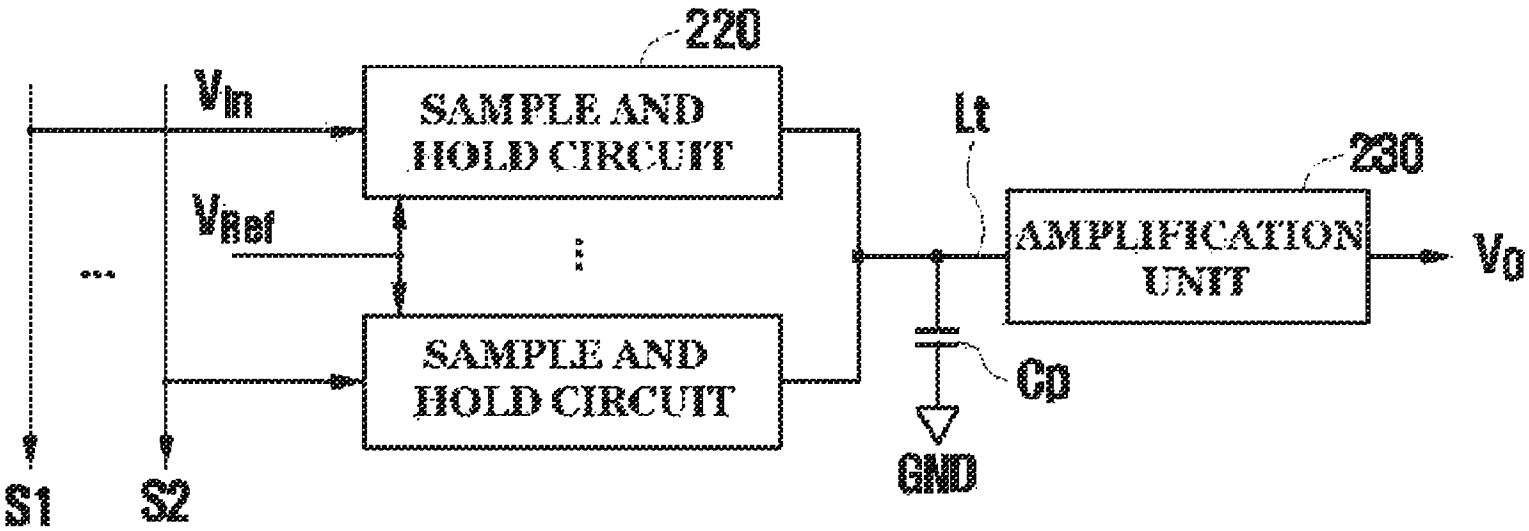
FIG. 2 is a schematic block diagram for explaining components of a source driver illustrated in FIG. 1.

FIG. 2 illustrates a path through which pixel information is transmitted in the source driver 121. In FIG. 2, the pixel information is represented by $V_{IN}$. The pixel information $V_{IN}$ of each OLED cell 143 may be provided to the sample and hold circuit 220. The sample and hold circuit 220 may be configured to provide a signal obtained by sampling and holding the pixel information $V_{IN}$ and a reference signal $V_{REF}$ to the amplification unit 230.

The sample and hold circuit 220 may receive the pixel information $V_{IN}$ of the OLED cell 143 of the display panel 141, and detect whether the pixel characteristic of the display panel 141 is changed. The source driver 121 may include a plurality of sample and hold circuits 220 corresponding to the number of data lines of the display panel 141. Output signals of the sample and hold circuits 220 may be commonly applied to the amplification unit 230.

The amplification unit 230 may receive the output signals of the sample and hold circuits 220, that is, the pixel information $V_{IN}$, differentially amplify the pixel information $V_{IN}$, and output the amplified information as differential signals. The differential operation of the amplification unit 230 may be performed on the pixel information $V_{IN}$ and the reference voltage $V_{REF}$, and a difference between the reference voltage $V_{REF}$ and the pixel information $V_{IN}$ may be outputted as a differential output Vo of the amplification unit 230.

The amplification unit 230 may be coupled to the sample and hold circuit 220 through a transmission line Lt. Since the transmission line Lt is short, external noise affecting the signal transmitted to the amplification unit 230 from the sample and hold circuit 220 is hardly introduced into the transmission line Lt.

However, when a plurality of sample and hold circuits 220 are coupled to the amplification unit 230, a large amount of current may flow through the transmission line Lt, and thus increase the capacitance of a parasitic capacitor Cp between a ground terminal GND and the transmission line Lt coupled to an input terminal of the amplification unit 230. That is, the length of the transmission line Lt may be increased, and the parasitic capacitance of the parasitic capacitor Cp may be increased by source-body junction capacitance and drain-body junction capacitance of a transistor (not illustrated) forming a multiplexer (not illustrated) required for sequentially coupling the sample and hold circuits 220 to the amplification unit 230 as a single circuit.

As such, when the parasitic capacitance of the parasitic capacitor Cp between the transmission line Lt and the ground terminal GND is increased, the offset voltage of the input terminal of the amplification unit 230 may be increased by the increased parasitic capacitance. That is, with the increase in parasitic capacitance of the parasitic capacitor Cp, the offset voltage of the input terminal of the amplification unit 230 and the output signal of the sample and hold circuit 220 may be amplified together by the amplification unit 230. Thus, the offset voltage between the source drivers may be increased. As a result, the offset voltage between the source drivers may appear as noise of an image displayed on the display panel 141.

Figure 3:
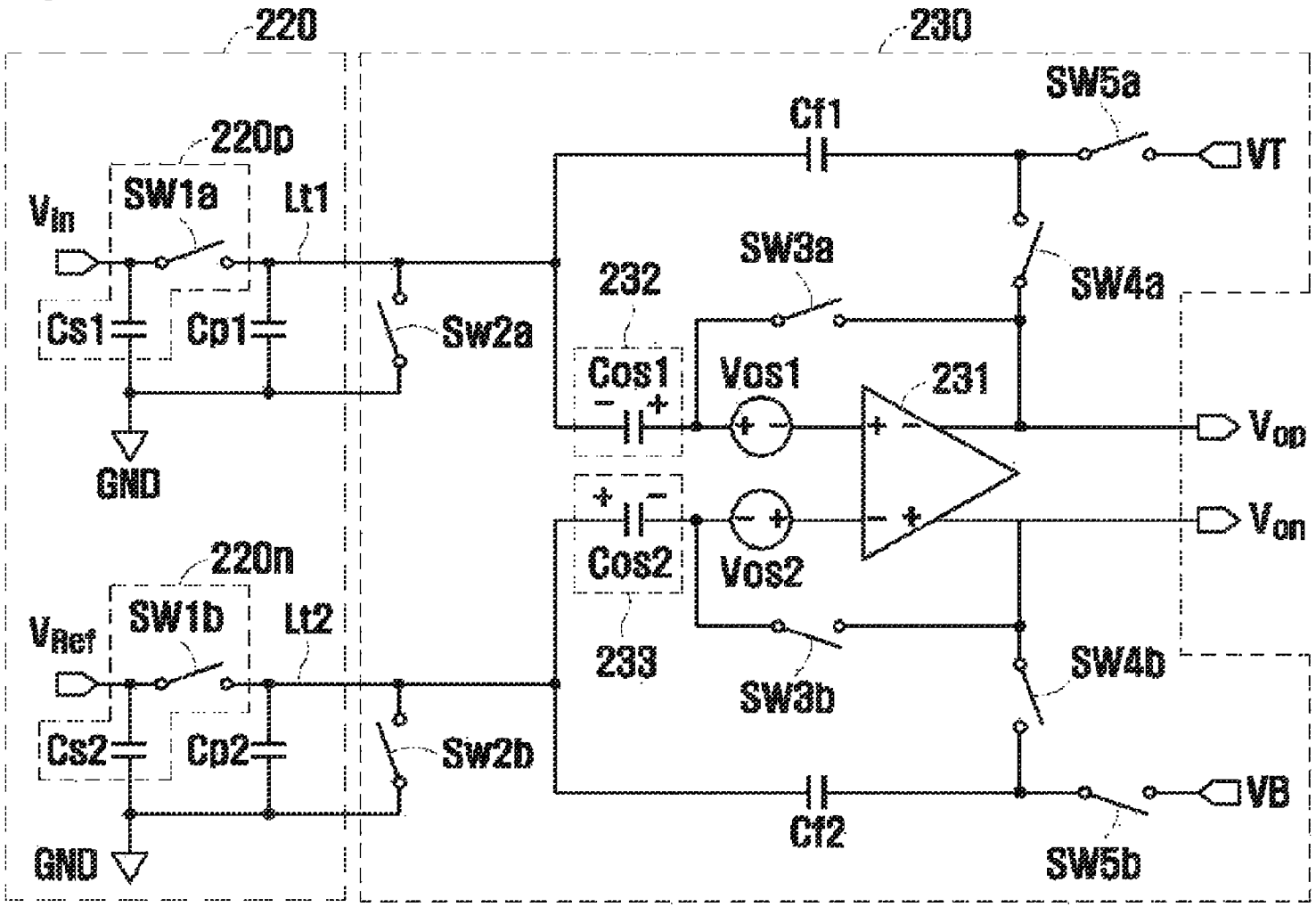
FIG. 3 is a circuit diagram illustrating an embodiment of a sample and hold circuit and an amplification unit illustrated in FIG. 2.

Referring to FIG. 3, the sample and hold circuit 220 may include a sample and hold circuit 220*p* configured to sample and hold the pixel information $V_{IN}$ and a sample and hold circuit 220*n* configured to sample and hold the reference voltage $V_{REF}$. FIG. 3 schematically illustrates that the sample and hold circuit 220*p* includes a sampling capacitor Cs1 and a switch SW1*a*, and the sample and hold circuit 220*n* includes a sampling capacitor Cs2 and a switch SW1*b*.

The sample and hold circuit 220*p* may be coupled to a transmission line Lt1 to which the pixel information $V_{IN}$ is inputted, and the sample and hold circuit 220*n* may be coupled to a transmission line Lt2 to which the reference voltage $V_{REF}$ is provided. The transmission lines Lt1 and Lt2 of FIG. 3 may be included in the transmission line Lt of FIG. 2. Furthermore, the parasitic capacitor Cp1 may be formed on the transmission line Lt1, and the parasitic capacitor Cp2 may be formed on the transmission line Lt2. The parasitic capacitors Cp1 and Cp2 of FIG. 3 may be included in the parasitic capacitor Cp of FIG. 2.

The amplification unit 230 of FIG. 3 may include two offset voltage storage units Cos1 and Cos2, two feedback capacitors Cf1 and Cf2, a plurality of switches SW2*a* to SW5*a*, and an amplifier 231. The configuration of the amplification unit 230 including two offset voltage storage units Cos1 and Cos2 and two feedback capacitors Cf1 and Cf2 may consider that the pixel information $V_{IN}$ and the reference voltage $V_{REF}$ are inputted as differential signals to a positive input terminal (+) and a negative input terminal (−) of the amplifier 231 through the sample and hold circuits 220*p* and 220, respectively.

The offset voltage storage units 232 and 233 may be coupled to the positive input terminal (+) and the negative input terminal (−) of the amplifier 231, respectively. The offset voltage storage units 232 and 233 may store offset voltages corresponding to offset voltages Vos1 and Vos2 formed in the positive input terminal (+) and the negative input terminal (−) of the amplifier 231. When output signals of the sample and hold circuits 220*p* and 220*n* are inputted to the amplifier 231, the offset voltages Vos1 and Vos2 of the input terminals of the amplifier 231 and the offset voltages stored in the offset voltage storage units 232 and 233 may offset each other. Since the offset voltages stored in the offset voltage storage units 232 and 233 have the opposite polarity to the offset voltages Vos1 and Vos2 of the input terminals of the amplifier 231, the offset voltages may offset each other. That is, the offset voltages Vos1 and Vos2 of the input terminals of the amplification unit 231 may be eliminated. The offset voltage storage units 232 and 233 may include offset capacitors Cos1 and Cos2.

As described above, the offset voltages Vos1 and Vos2 of the input terminals of the amplification unit 231 may be eliminated by the offset voltages of the offset voltage storage units 232 and 233. Thus, output signals Vop and Von of the amplification unit 230 may be stably outputted without being affected by the offset voltages Vos1 and Vos2. As the amplification unit 230 stably maintains the output signals without being influenced by the offset voltages Vos1 and Vos2, the yield of the source driver 121 may be improved.

The sample and hold circuits 220*p* and 220*n* and the amplification unit 230 may include switches SW1*a* to SW5*b* implemented with MOS (metal oxide semiconductor) transistors.

The sample and hold circuits 220*p* and 220*n* may include switches SW1*a* and SW1*b* for distinguishing between a sampling mode and a hold mode. The hold mode of the sample and hold circuits 220*p* and 220*n* may correspond to an amplification mode to be described below.

The amplification unit 230 may include switches SW2*a* and SW2*b*, switches SW3*a* and SW3*b*, switches SW4*a* and SW4*b*, and switches SW5*a* and SW5*b*. The switches SW2*a* and SW2*b* may switch the couplings between the ground terminal and the parasitic capacitors Cp1 and Cp2 of the transmission lines Lt1 and Lt2, respectively. The switches SW3*a* and SW3*b* may switch the transmission of outputs of the amplifier 231 to nodes between the offset voltage storage units 232 and 233 and the input terminals of the amplifier 231, respectively. The switches SW4*a* and SW4*b* may switch the transmission of the outputs of the amplifier 231 to the feedback capacitors Cf1 and Cf2, respectively. The switches SW5*a* and SW5*b* may transmit voltages VT and VB to the feedback capacitors Cf1 and Cf2, respectively. The switches SW4*a* and SW4*b* and the switches SW5*a* and SW5*b* may be coupled in parallel to the feedback capacitors Cf1 and Cf2, respectively.

Figure 4:
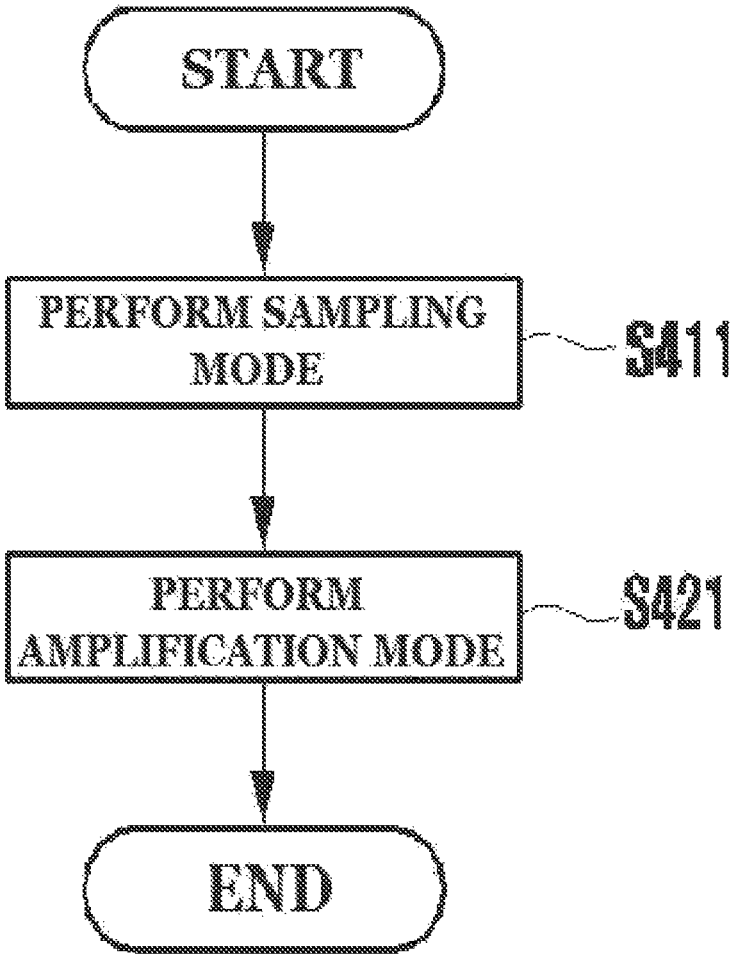
FIG. 4 is a flowchart for explaining an offset voltage elimination method in accordance with an embodiment of the present invention.
Figure 5:
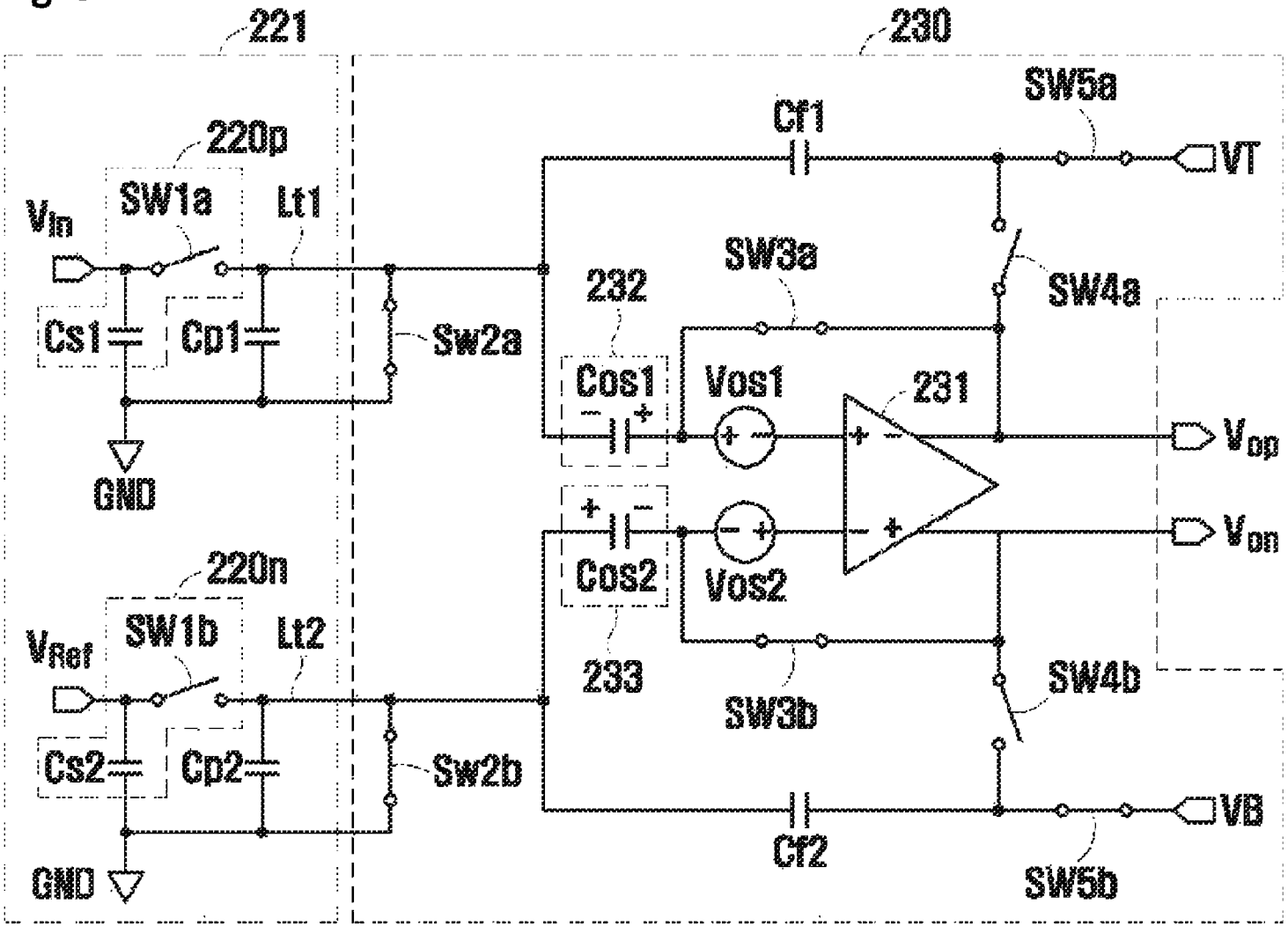
FIG. 5 is a circuit diagram for explaining a state in which the embodiment of FIG. 3 performs a sampling operation.
Figure 6:
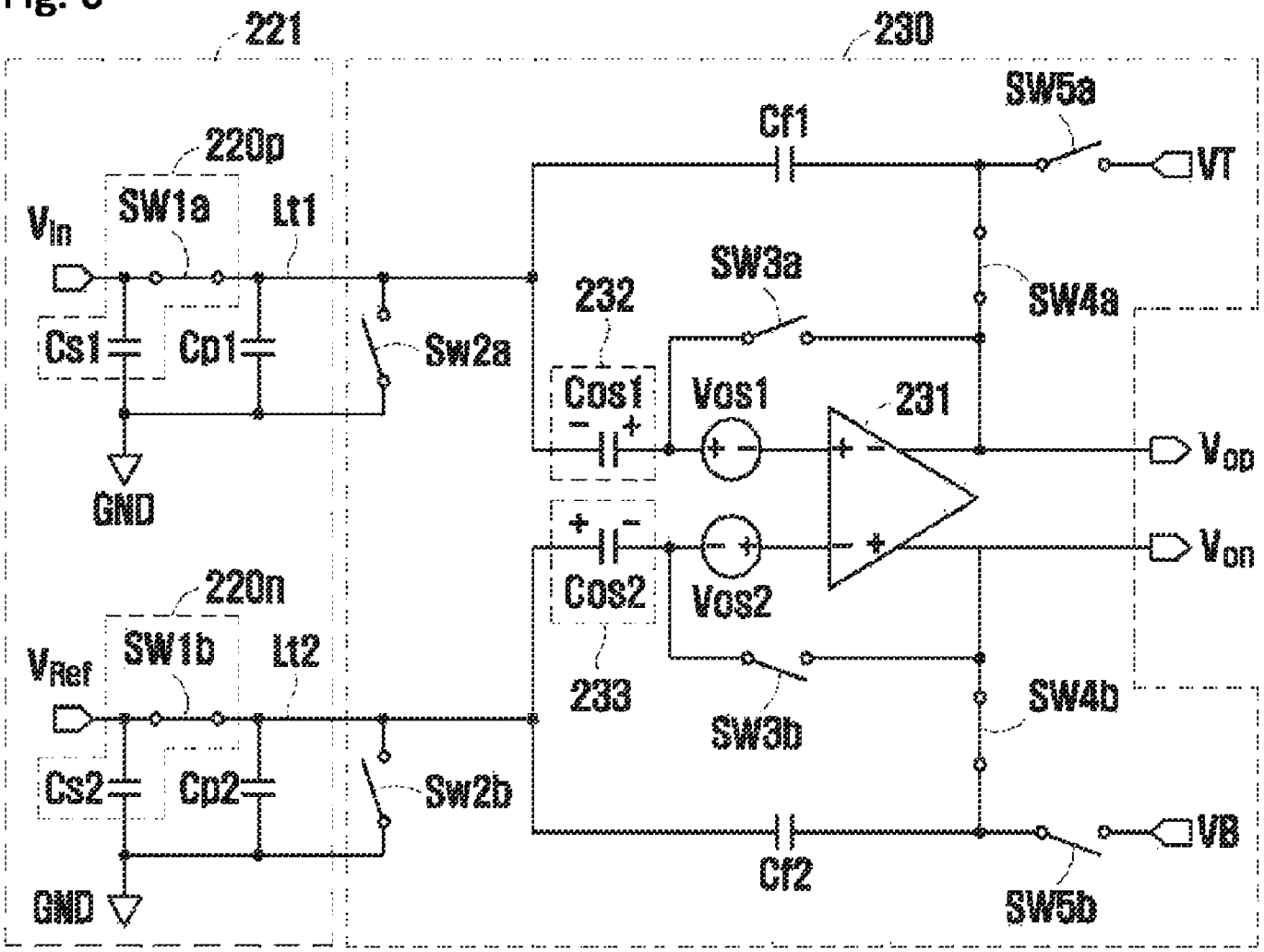
FIG. 6 is a circuit diagram for explaining a state in which the embodiment of FIG. 3 performs an amplification operation.

FIG. 4 is a flowchart for explaining an offset voltage elimination method in accordance with an embodiment of the present invention. FIG. 5 is a configuration diagram when the amplification unit 230 and the sample and hold circuits 230*p* and 230*n* of FIG. 3 operate in the sampling mode. FIG. 6 is a configuration diagram when the amplification unit 230 and the sample and hold circuits 230*p* and 230*n* of FIG. 3 operate in the amplification mode. Referring to FIGS. 3, 5, and 6, the offset voltage elimination method of FIG. 4 will be described.

Referring to FIG. 4, the offset voltage elimination method may include first and second steps S411 and S421.

The sampling mode may be performed as the first step 411. In response to the sampling mode, the amplification unit 230 may store offset voltages, corresponding to the offset voltages Vos1 and Vos2 generated at the input terminals of the amplifier 231, in the offset capacitors Cos1 and Cos2, respectively. The operations of the amplification unit 230 and the sample and hold circuits 220*p* and 220*n* in the sampling mode will be described with reference to FIG. 5.

In the sampling mode, the switches SW2*a*, SW2*b*, SW3*a*, SW3*b*, SW5*a*, and SW5*b* may be turned on, and the switches SW1*a*, SW1*b*, SW4*a*, and SW4*b* may be turned off.

First, the sampling mode of FIG. 5 corresponding to the pixel information $V_{IN}$ will be described.

As the switch SW1*a* is turned off, the sampling capacitor Cs1 may be isolated from the transmission line Lt1. Thus, the pixel information $V_{IN}$ inputted to the sample and hold circuit 220*p* may not be transmitted to the transmission line Lt1 and the amplifier 231, but stored in the sampling capacitor Cs1. That is, the pixel information $V_{IN}$ may be sampled in the sampling capacitor Cs1.

As the switch SW2*a* is turned on, a closed loop including the parasitic capacitor Cp1 may be formed, and the parasitic capacitor Cp1 may be electrically isolated from the amplifier 231.

As the switch SW3*a* is turned on, the amplifier 231 may operate as a unity buffer, and the offset voltage Vos1 of the positive input terminal (+) of the amplifier 231 may be transmitted to the output terminal as it is. As the positive input terminal (+) and the negative terminal (−) of the amplifier 231 are coupled to each other, the voltage outputted from the negative output terminal (−) of the amplifier 231 may be stored in the offset capacitor Cos1. That is, an offset voltage, which has the same magnitude as the offset voltage Vos1 generated at the positive input terminal (+) of the amplifier 231 and the opposite sign of the offset voltage Vos1, may be stored in the offset capacitor Cos1. At this time, the amplifier 231 may have an amplification factor set to 1.

As the switch SW4*a* is turned off and the switch SW5*a* is turned on, the feedback capacitor Cf1 may be isolated from the negative output terminal (−) of the amplifier 231, and coupled to the voltage VT. Thus, the voltage VT may be stored in the feedback capacitor Cf1.

That is, in response to the sampling mode, the pixel information $V_{IN}$ may be stored in the sampling capacitor Cs1, and an offset voltage having the same magnitude as the offset voltage Vos1 generated at the positive input terminal (+) of the amplifier 231 and the opposite sign of the offset voltage Vos1 may be stored in the offset capacitor Cos1.

Furthermore, the sampling mode operation of FIG. 5 corresponding to the reference voltage $V_{REF}$ will be described.

As the switch SW1*b* is turned off, the sampling capacitor Cs2 may be isolated from the transmission line Lt2. Thus, the reference voltage $V_{REF}$ inputted to the sample and hold circuit 220*n* may not be transmitted to the transmission line Lt2 and the amplifier 231, but stored in the sampling capacitor Cs2. That is, the reference voltage $V_{REF}$ may be sampled in the sampling capacitor Cs2.

As the switch SW2*b* is turned on, a closed loop including a parasitic capacitor Cp2 may be formed, and the parasitic capacitor Cp2 may be electrically isolated from the amplifier 231.

As the switch SW3*b* is turned on, the amplifier 231 may serve as a unity buffer, and the offset voltage Vos2 of the negative input terminal (−) of the amplifier 231 may be transmitted to the output terminal as it is. As the negative input terminal (−) and the positive output terminal (+) of the amplifier 231 are coupled to each other, the voltage outputted from the positive output terminal (+) of the amplifier 231 may be stored in the offset capacitor Cos2. That is, an offset voltage having the same magnitude as the offset voltage Vos2 generated at the negative input terminal (−) of the amplifier 231 and the opposite sign of the offset voltage Vos2 may be stored in the offset capacitor Cos2. At this time, the amplifier 231 may have an amplification factor set to 1.

As the switch SW4*b* is turned off and the switch SW5*b* is turned on, the feedback capacitor Cf2 may be isolated from the positive output terminal (−) of the amplifier 231 and coupled to the voltage VB. Thus, the voltage VB may be stored in the feedback capacitor Cf2.

That is, in response to the sampling mode, the reference voltage $V_{REF}$ may be stored in the sampling capacitor Cs2, and an offset voltage having the same magnitude as the offset voltage Vos2 generated at the negative input terminal (−) of the amplifier 231 and the opposite sign of the offset voltage Vos2 may be stored in the offset capacitor Cos2.

In the sampling mode, the voltages VT and VB may be applied in a different manner depending on the configuration of the circuit. When the circuit is implemented as a differential amplification circuit, the same voltage (half of power supply voltage) may be used as the voltages VT and VB, and when a single voltage is converted into differential voltages through a data converter, different voltages may be used as the voltage VT and VB. In this case, the voltage VT may be set higher than the voltage VB (VT>VB), and the voltage VB may correspond to the maximum input voltage of the data converter. This is in order to prevent distortion caused by signal saturation which may occur due to a low power supply voltage.

The amplification mode may be performed as a second step S421. In response to the amplification mode, the amplification unit 230 may perform the amplification mode for eliminating the offset voltages Vos1 and Vos2 generated at the input terminal of the amplifier 231 by offsetting the offset voltages Vos1 and Vos2 with the offset voltages stored in the offset capacitors Cos1 and Cos2. The operations of the amplification unit 230 and the sample and hold circuits 221*p* and 221*n* in the amplification mode will be described.

In the amplification mode, the switches SW1*a*, SW1*b*, SW4*a*, and SW4*b* may be turned on, and the switches SW2*a*, SW2*b*, SW3*a*, SW3*b*, SW5*a*, and SW5*b* may be turned off.

First, the amplification mode of FIG. 6 corresponding to the pixel information $V_{IN}$ will be described.

As the switch SW1*a* is turned on and the switch SW2*a* is turned off, the voltage of the sampling capacitor Cs1 storing the pixel information $V_{IN}$ and the voltage of the parasitic capacitor Cp1 may be combined and applied to the offset capacitor Cos1.

As the switch SW3*a* is turned off, the positive input terminal and the negative output terminal of the amplifier 231 may be isolated from each other, and the operation of the amplifier 231 serving as a unity buffer may be canceled. That is, the amplifier 231 may amplify signals applied to the positive input terminal (+) by a predetermined amplification factor, and output the amplified signals.

As the switch SW5*a* is turned off and the switch SW4*a* is turned off, the feedback capacitor Cf1 may be coupled to the negative output terminal of the amplifier 231 and isolated from the voltage VT. Furthermore, the feedback capacitor Cf1 may be coupled to the sampling capacitor Cs1 so as to form a feedback loop.

The offset voltage stored in the offset capacitor Cos1 may have the same magnitude as the offset voltage Vos1 of the positive input terminal (+) of the amplifier 231 and the opposite sign of the offset voltage Vos1, and the offset voltage stored in the offset capacitor Cos1 and the offset voltage of the positive input terminal (+) of the amplifier 231 may offset each other. That is, the amplifier 231 may amplify a signal without being influenced by the offset voltage Vo1 generated at the positive input terminal (+). Furthermore, the voltage having been stored in the sampling capacitor Cs1 may be transmitted to the feedback capacitor Cf1. Thus, the pixel information $V_{IN}$ may be amplified according to the ratio of the sampling capacitor Cs1 and the parasitic capacitor Cp1 to the feedback capacitor Cf1, and outputted from the amplifier 231.

That is, the signal inputted to the amplifier 231 may be amplified at an amplification factor of Cf1/Cs1, without being influenced by the offset voltage.

The amplification mode of FIG. 6 corresponding to the reference voltage $V_{REF}$ will be described.

As the switch SW1*b* is turned on and the switch SW2*b* is turned off, the voltage of the sampling capacitor Cs2 storing the reference voltage and the voltage of the parasitic capacitor Cp2 may be combined and applied to the offset capacitor Cos2.

As the switch SW3*b* is turned off, the negative input terminal (−) and the positive output terminal (+) of the amplifier 231 may be isolated from each other, and the operation of the amplification unit 231 serving as a unity buffer may be canceled. That is, the amplifier 231 may amplify signals applied to the negative input terminal (−) by a predetermined amplification factor, and output the amplified signals.

As the switch SW5*b* is turned off and the switch SW4*b* is turned off, the feedback capacitor Cf2 may be coupled to the positive output terminal (+) of the amplifier 231, and isolated from the voltage VB. Furthermore, the feedback capacitor Cf2 may be coupled to the sampling capacitor Cs2 so as to form a feedback loop.

The offset voltage stored in the offset capacitor Cos2 may have the same magnitude as the offset voltage Vos2 generated at the negative input terminal (−) of the amplifier 231 and the opposite sign to the offset voltage Vos2, and the offset voltage stored in the offset capacitor Cos2 and the offset voltage Vos2 of the negative input terminal (−) of the amplifier 231 may offset each other. That is, the amplifier 231 may amplify a signal without being influenced by the offset voltage Vos2 generated at the negative input terminal. Furthermore, the voltage having been stored in the sampling capacitor Cs2 may be transmitted to the feedback capacitor Cf2. Thus, the reference voltage $V_{REF}$ may be amplified according to the ratio of the sampling capacitor Cs2 and the parasitic capacitor Cp2 to the feedback capacitor Cf2, and outputted from the amplifier 231.

As described above, the signals inputted to the amplifier 231 may be amplified at an amplification factor of Cf2/Cs2, without being influenced by the offset voltage.

The offset voltages Vos1 and Vos2 may be formed by a mismatch between a differential pair of unit transistors forming the amplifier 231, for example, an operational amplifier.

In order to reduce the magnitude of the offset voltages Vos1 and Vos2, the area of the unit transistor needs to be increased.

However, when the offset voltage elimination method is applied, the same performance may be obtained even through a unit transistor having a smaller area than in the conventional method. The area of the unit transistor may be reduced to acquire a high open loop gain of the amplifier 231.

The offset voltages Vos1 and Vos2 of the amplifier may be amplified by Cf/(Cs+Cp) in the amplification mode, and then affect the output terminals of the amplifier 231. Thus, the size of the feedback capacitors Cf1 and Cf2 needs to be increased.

Since the ratio (Cf/Cs) of the sampling capacitors Cs1 and Cs2 to the feedback capacitors Cf1 and Cf2 is determined at a design step, the capacity of the sampling capacitors Cs1 and Cs2 may be increased in proportion to the increase in capacity of the feedback capacitors Cf1 and Cf2.

The increase in number of sampling capacitors Cs1 and Cs2 of the source driver may affect the increase in area of the source driver.

However, when the offset voltage elimination method in accordance with the embodiment of the present invention is applied, the same effect may be obtained even though the feedback capacitors Cf1 and Cf2 and the sampling capacitors Cs1 and Cs2 are designed to have a smaller size. Thus, the area of the source driver may be effectively reduced.

Figure 7:
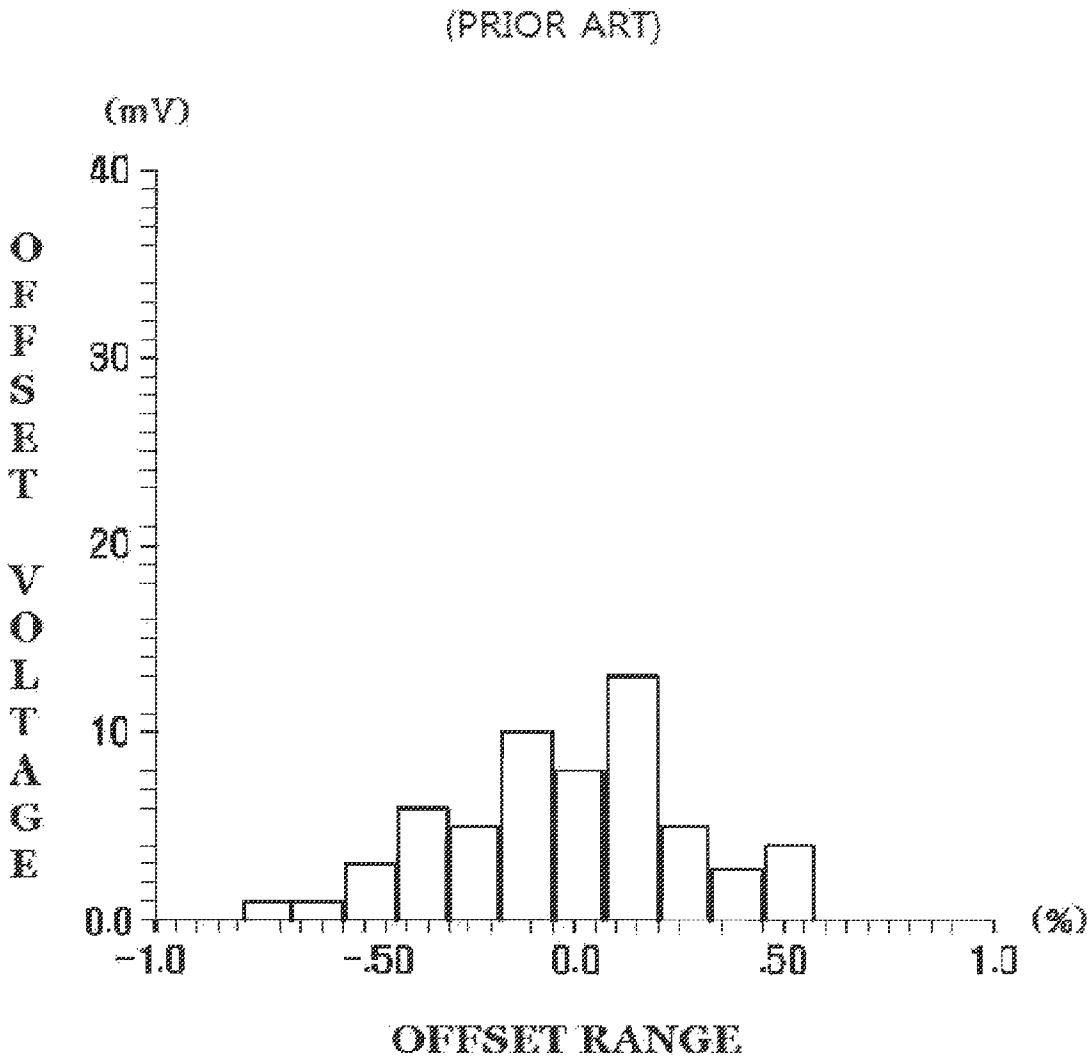
FIG. 7 is a histogram of offset voltages when the offset voltage elimination method in accordance with the embodiment of the present invention is not applied.
Figure 8:
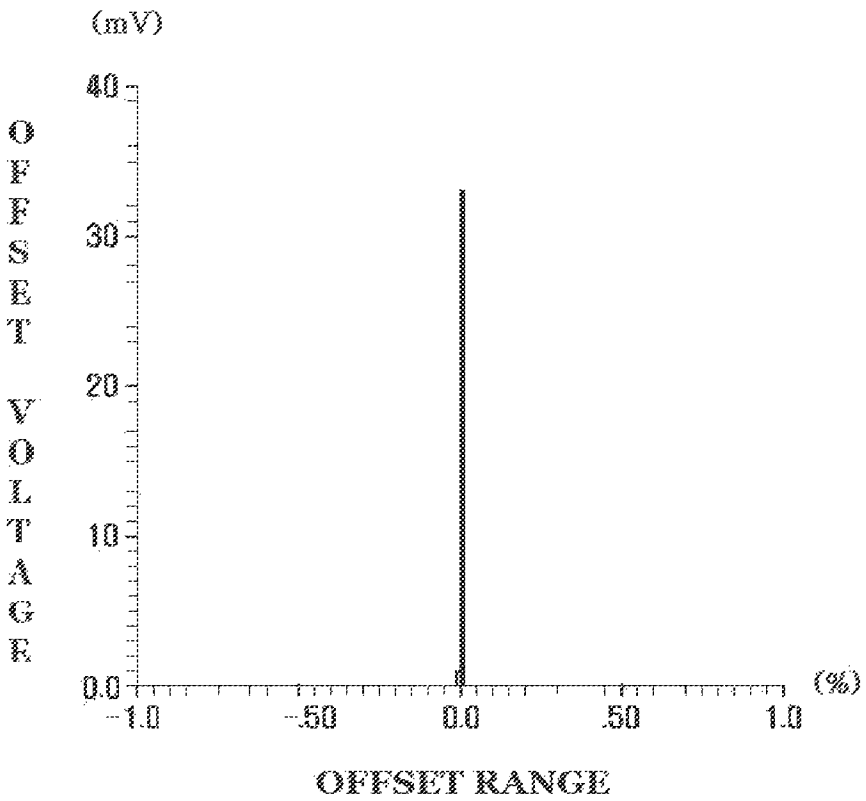
FIG. 8 is a histogram of offset voltages when the offset voltage elimination method in accordance with the embodiment of the present invention is applied.

FIG. 7 is a histogram of amplified offset voltages when the offset voltage elimination method in accordance with the embodiment of the present invention is not applied. FIG. 8 is a histogram of offset voltages when the offset voltage elimination method in accordance with the embodiment of the present invention is applied.

FIGS. 7 and 8 are histograms obtained through a Monte Carlo simulation method. The Monte Carlo simulation refers to a method for estimating the performance of an integrated circuit device as a probability for a mismatch and performance change which may occur during a fabrication process of the integrated circuit device.

During the simulation, suppose that outputs of the amplifier 231 of FIG. 3 are set in the range of −1V to 1V. When the offset voltage elimination method is not applied, the outputs of the amplifier 231 of FIG. 3 have an output offset voltage of −0.8V to 0.6V. When an output offset voltage of −0.1V to 0.1V corresponds to a pass, the source driver has a yield of 14%.

When the offset voltage elimination method is applied, outputs of the amplifier 231 of FIG. 3 are distributed in the range of −0.02V to 0.02V, and the source driver has a yield of 100%.

When the offset voltage elimination method is applied, a normal distribution value is 99 times smaller than when the offset voltage elimination method is applied (2.9 mV:287.5 mv).

When the offset voltage elimination method is not applied, offset voltages corresponding to about 86% of the entire range may be generated. The offset voltages of about 10 mV may be amplified by the influence of the parasitic capacitors Cp1 and Cp2 and appear at the output terminals of the amplifier 231 of FIG. 3.

When the offset voltage elimination method is applied, offset voltages corresponding to about 0.9% of the entire range may be generated.

According to the embodiment of the present invention, the amplification unit for amplifying an output signal of the sample and hold circuit may include the offset voltage storage unit, and the amplification of the offset voltage of the amplification unit may be controlled by the offset voltage stored in the offset voltage storage unit. Thus, although the parasitic capacitance of the input terminal of the amplification unit is increased as the plurality of sample and hold circuits are coupled to the input terminal of the amplification unit, the offset voltage may be stably controlled.

Thus, the output signal of the amplification unit for a high-speed operation of the analog-to-digital converter may be stably controlled, and the difference in offset voltage between the source drivers may be reduced to thereby improve the yield of the source drivers.

Furthermore, although the area of the unit transistor formed in the amplification unit is reduced, the source driver may exhibit the same performance. Since the unit transistor can be designed to have a small area, the signal processing speed of the source driver may be improved, and a high open loop gain of the amplification unit may be acquired.

Furthermore, although the feedback capacitors and the sampling capacitors which are coupled to the amplification unit are designed to have a small size, the source driver may obtain the same effect. The area of the source driver in accordance with the embodiment of the present invention may be effectively reduced.

Although a preferred embodiment of the present invention has been described for illustrative purposes, those skilled in the art will appreciate that various modifications, additions and substitutions are possible, without departing from the scope and the spirit of the invention as disclosed in the accompanying claims.

What is claimed is:

1. A source driver comprising:

a transmission line configured to transmit an output signal of a sample and hold circuit which stores pixel information of an organic light emitting diode (OLED) cell;

an amplifier having an input terminal at which a first offset voltage is formed by a parasitic capacitor of the transmission line;

an offset voltage storage unit storing the first offset voltage outputted from the amplifier as a second offset voltage while the transmission of the output signal of the sample and hold circuit through the transmission line is turned off, and offsetting the first offset voltage by providing the second offset voltage to the input terminal of the amplifier when the output signal of the sample and hold circuit is transmitted through the transmission line; and a switch group having a plurality of switches which isolates the sample and hold circuit and the amplifier from each other, couples the input terminal and an output terminal of the amplifier, and operates the amplifier as a unity buffer, while the transmission of the output signal of the sample and hold circuit is turned off.

2. The source driver of claim 1, wherein the amplifier has a first amplification factor for storing the second offset voltage and a second amplification factor for amplifying the output signal of the sample and hold circuit, and the first and second amplification factors are different from each other.

3. The source driver of claim 2, wherein the first amplification factor of the amplifier is set to 1.

4. A source driver comprising:

a sample and hold circuit storing pixel information inputted from an OLED cell of a display panel in response to a sampling mode and outputting the stored pixel information in response to an amplification mode;

an amplifier having an in at terminal at which a first offset voltage is formed, and outputting a second offset voltage corresponding to the first offset voltage in response to the sampling mode and amplifying an output signal of the sample and hold circuit, applied to the input terminal through a transmission line, in response to the amplification mode;

an offset voltage storage unit storing the second offset voltage in response to the sampling mode, and provide the second offset voltage to the input terminal of the amplifier in response to the amplification mode;

a feedback capacitor storing a voltage for amplification in response to the sampling mode, and provide a feedback path for the amplifier in response to the amplification mode; and a first switch group having a plurality of switches which isolates the sample and hold circuit and the amplifier from each other, couples the input terminal and an output terminal of the amplifier, and operates the amplifier as a unity buffer, in response to the sampling mode.

5. The source driver of claim 4, further comprising a second switch group turned on in response to the amplification mode, as the first switch group is turned on, a parasitic capacitor of the transmission line and the offset voltage storage unit are isolated from each other, the feedback path is canceled, and the output of the amplifier for the first offset voltage is transmitted to the offset voltage storage unit to store the second offset voltage, and as the second switch group is turned on, the output of the sample and hold circuit is transmitted to the input terminal of the amplifier through the transmission line and the offset voltage storage unit, and the feedback path for amplification of the amplifier is formed.

6. The source driver of claim 4, wherein the sample and hold circuit comprises a first switch provided among internal sampling capacitors which are formed in parallel and the parasitic capacitor of the transmission line, and wherein the first switch group comprises a second switch isolating the parasitic capacitor from the offset voltage storage unit of the amplifier when the second switch is coupled in parallel to the parasitic capacitor and turned on, a third switch transmitting the output of the amplifier to the offset voltage storage unit when the third switch is coupled between the input terminal and an output terminal of the amplifier and turned on, a fourth switch forming the feedback path and transmitting the output of the amplifier to the feedback capacitor, when the fourth switch is coupled between the feedback capacitor and the output terminal of the amplifier and turned on, and a fifth switch charging the feedback capacitor with a reference voltage when the fifth switch is coupled between the feedback capacitor and the reference voltage and turned on.

7. A source driver comprising:

a first sample and hold circuit storing pixel information inputted from an OLED cell of a display panel in response to a sampling mode, and outputting the stored pixel information in response to an amplification mode;

a second sample and hold circuit storing a reference voltage in response to the sampling mode and outputting the stored reference voltage in response to the amplification mode; and an amplification unit storing a first offset voltage of a positive input terminal as a third offset voltage and storing a second offset voltage of a negative input terminal as a fourth offset voltage in response to the sampling mode, offsetting the first and second offset voltages by the third and fourth offset voltages in response to the amplification mode, and differentially amplifying output signals of the first and second sample and hold circuits, provided through a transmission line, wherein the amplification unit comprises:

an amplifier having the positive input terminal and the negative input terminal at which the first and second offset voltages are formed by a parasitic capacitor of the transmission line;

a first offset voltage storage unit storing the third offset voltage outputted from a negative output terminal of the amplifier in response to the first offset voltage of the positive input terminal while the transmission of the output signal of the first sample and hold circuit through the transmission line is turned off, and offsetting the first offset voltage of the positive input terminal by providing the third offset voltage to the positive input terminal of the amplifier when the output signal is transmitted from the first sample and hold circuit through the transmission line; and a second offset voltage storage unit storing the fourth offset voltage outputted from a positive output terminal of the amplifier in response to the second offset voltage of the negative input terminal while the transmission of the output signal of the second sample and hold circuit through the transmission line is turned off, and offsetting the second offset voltage of the negative input terminal by providing the fourth offset voltage to the negative input terminal of the amplifier when the output signal is transmitted from the second sample and hold circuit through the transmission line.

8. A source driver comprising:

a sample and hold circuit storing an input signal in response to a sampling mode and outputting the stored input signal in response to an amplification mode;

an amplifier outputting a first offset voltage in response to the sampling mode, and amplifying and outputting, an output signal of the sample and hold circuit in response to the amplification mode;

an offset voltage storage unit storing the first offset voltage of the amplifier as a second offset voltage having the opposite polarity, in response to the sampling mode, and offsetting the first offset voltage by providing the second offset voltage to an input terminal of the amplifier in response to the amplification mode;

a first switch isolating the sample and hold circuit and the amplifier from each other in response the sampling mode; and a second switch coupling the input terminal and an output terminal of the amplifier in response to the sampling mode, and operating the amplifier as a unity buffer.

9. The source driver of claim 8, wherein the amplifier operates as a unity buffer in response to the sampling mode, and amplifies the output signal of the sample and hold circuit in response to the amplification mode.

* * * * *